United States Patent [19]

Kremers et al.

[11] Patent Number: 5,007,625

[45] Date of Patent: Apr. 16, 1991

[54] SELECTABLE SHEET OFFSETTING

[75] Inventors: Henry T. Kremers, Rochester; Khalid M. Rabb, Webster, both of N.Y.

[73] Assignee: Xerox Corporation, Stamford, Conn.

[21] Appl. No.: 398,858

[22] Filed: Aug. 24, 1989

[51] Int. Cl.[5] ..... B42B 2/00

[52] U.S. Cl. ..... 270/53; 270/58; 271/213

[58] Field of Search ..... 270/58, 53, 37; 271/213, 285, 286; 414/791.2

[56] References Cited

U.S. PATENT DOCUMENTS

| | | | |
|---|---|---|---|
| 4,134,672 | 1/1979 | Burlew | 270/58 |
| 4,603,971 | 8/1986 | Kukucka et al. | 355/133 |
| 4,735,408 | 4/1988 | Yamashita | 271/213 |

FOREIGN PATENT DOCUMENTS

| | | | |
|---|---|---|---|
| 38072 | 3/1979 | Japan | 271/213 |
| 12045 | 1/1984 | Japan | 414/791.2 |
| 114961 | 6/1986 | Japan | 271/213 |
| 295969 | 12/1986 | Japan | 414/791.2 |

OTHER PUBLICATIONS

IBM Technical Disclosure Bulletin; Vetione, "Sheet Stacking Technique", vol. 17, No. 8, 1/75.

Xerox Disclosure Journal; Looney, "Copy Set Collecting Apparatus", vol. 2, No. 4, Jul./Aug. 1977.

*Primary Examiner*—John T. Kwon

*Assistant Examiner*—Therese M. Newholm

*Attorney, Agent, or Firm*—H. Fleischer; J. E. Beck; R. Zibelli

[57] ABSTRACT

An apparatus which regulates offsetting stacks of sheets reproduced from at least one original document. In one mode, successive stacks of uncollated sheets are offset from one another, and, in another mode, offsetting of stacks of collated copy sheets is inhibited.

16 Claims, 4 Drawing Sheets

SELECTABLE SHEET OFFSETTING

This invention relates generally to an electrophotograpic printing machine, and more particularly concerns an apparatus for regulating offsetting stacks of copy sheets reproduced from at least one original document.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photocondutive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. The copy sheets are collected into unfinished stacks of copy sheets. The collected copy sheets may then be bound or stapled together into finished stacks of copy sheets. Finished or unfinished stacks of copy sheets are then stacked for presentation to the machine operator.

In a high speed commercial printing machine of the foregoing type, large volumes of finished or unfinished stacks of copy sheets are fed onto a stacking tray. The copy sheets of each stack have the edges of their edges aligned. In many applications, it is desirable to have the stacks of copy offset from one another so that individual stacks of copy sheets may be more easily identified. One type of electrophotographic printing machine that provides this feature is the Xerox Model No. 1090 which automatically offsets each complete stack of collated copy sheets. However, uncollated copy sheets are not offset from one another in the tray for operator removal. In order to increase the flexibility of the printing machine in a centralized reproduction department, it is desirable to offset adjacent stacks of uncollated copy sheets of the same original document. This enables stacks of copy sheets to be reproduced from the same original document so that the operator may produce pads. Furthermore, on occasion, it is desirable not to offset stacks or sets of collated sheets from one another. This facilitates the packing of large numbers of stacks of collated sheets in boxes.

Various approaches have been devised for controlling offsetting of successive stacks copy sheets from one another. The following disclosure appears to be relevant: U.S. Pat. No. 4,603,971—Pantentee: KuKucKa et al. Issued: Aug. 5, 1986.

The relevant portions of the foregoing patent may be summarized as follows:

U.S. Pat. No. 4,603,971 discloses a printing machine which includes a finisher that can switch between modes of operation. The finisher may operate in either a stack mode, a staple set mode, or a bound set mode.

The printing machine has a controller and a switch for changing modes.

In accordance with one aspect of the present invention, there is provided an apparatus for regulating offsetting stacks of sheets reproduced from at least one original document. The apparatus includes means for controlling offsetting of adjacent stacks of sheets from one another so that in one mode successive stacks of sheets are offset from one another and in another mode offsetting of the stacks of copy sheets from one another is inhibited. Means are provided for receiving and supporting the sheets. Means, reponsive to the controlling means, move the receiving and supporting means at selected intervals to offset each stack from one another. The moving means is de-energized in response to the controlling means inhibiting offsetting of the stacks of copy sheets from one another.

Pursuant to another aspect of the features of the present invention, there is provided an electrophotographic printing machine of the type in which copy sheets reproduced from at least one original documents are advanced to a finishing station for finishing and delivery of stacks of copy sheets to the printing machine operator. The improvement to the printing machine includes means for controlling offsetting of adjacent stacks of copy sheets from one another with successive stacks of copy sheets being offset from one another in one mode and offsetting of the stacks of copy sheets from one another being inhibited in another mode. Means are provided for receiving and supporting the sheets. Means, responsive to the controlling means, moves the receiving and supporting means at selected intervals to offset each stack from one another. The moving means is de-energized in response to the controlling means inhibiting offsetting of the stacks of copy sheets from one another.

Other aspects of the present invention will become apparent as the following description proceeds and upon reference to the drawings, in which.

While the present invention will hereinafter be described in connection with a preferred embodiment thereof, will be understood that is not intended to limit the invention to that embodiment. On the contrary, it is intended to cover all alternatives, modifications, and equivalents, as may be included within the spirit and scope of the invention as defined by the appended claims.

Figure 1:
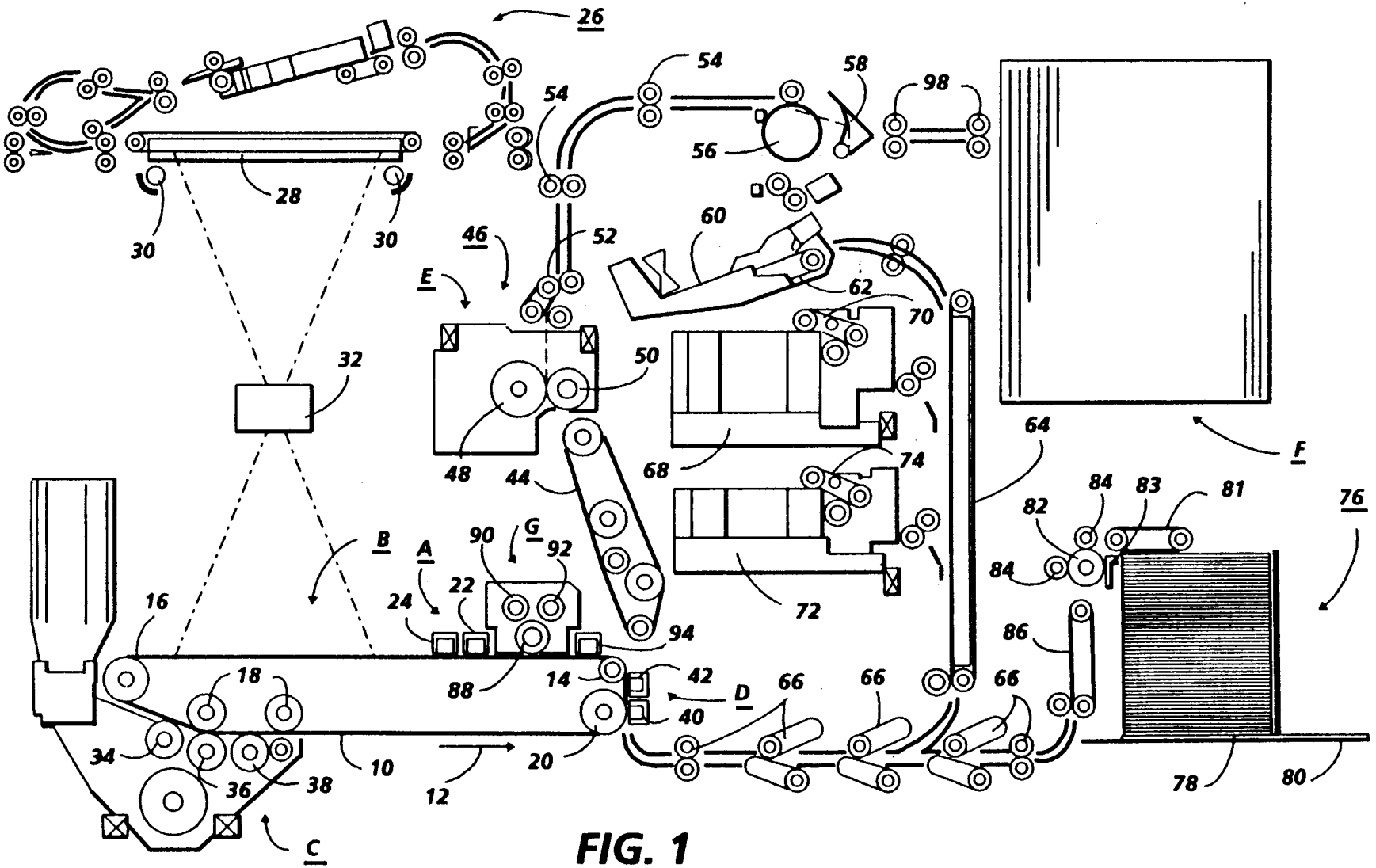
FIG. 1 is a schematic elevational view depicting an illustrative electrophotographic printing machine incorporating a finisher having the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds original documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the top of the stack of orginal documents through the feed roll pair. A position gate provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. In this way, a plurality of original documents may be sequentially exposed. Alternatively, document handling unit 26 may be pivoted away from platen 28 and an original document positioned manually thereon. One or more copies of the original document may be reproduced by the printing machine. The original document is exposed and a latent image recorded on the photoconductive belt. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photocoductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in compiler trays to form stacks of copy sheets. The stacks of copy sheets may remain unfinished or may be finished by being attached to one another. The sheets of each stack are attached to one another by either a binding device or a stapling device. In either case, a plurality of finished or unfinished stacks of copy sheets are formed in finishing station F. The stacks of copy sheets are delivered to a stacker. In the stacker, each stack of copy sheets may be offset from one another, or offsetting may be inhibited and the stacks of copy sheets aligned with one another. The operator selects the number of uncollated copy sheets in a stack and the stacks of uncollated copy sheets may be offset from one another. Alternatively, the operator may inhibit the offsetting stacks of collated copy sheets from one another. Further details of controlling offsetting stacks of copy sheets will be described hereinafter with reference to FIG. 4. The general operation of finishing station F will be described hereinafter with reference to FIG. 2.

With continued reference to FIG. 1, when duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary source of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

Figure 4:
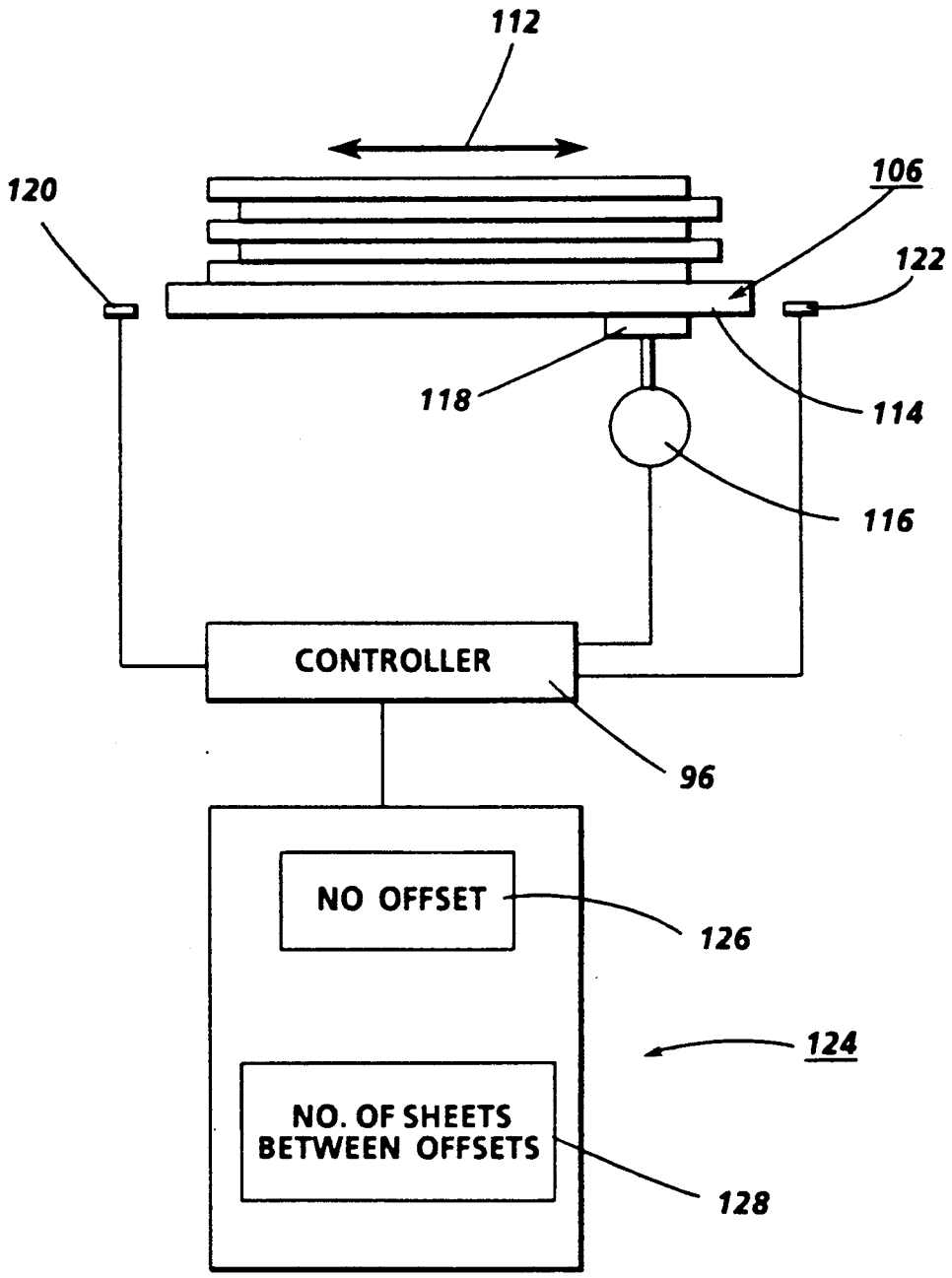
FIG. 4 is a schematic elevational view depicting the FIG. 3 and control system for regulating offsetting of stacks of copy sheets.

The various machine functions are regulated by a controller 96 (FIG. 4). The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected. Further details of the operation of controller 96 for regulating offsetting stacks of copy sheets will be described hereinafter with reference to FIG. 4.

Figure 2:
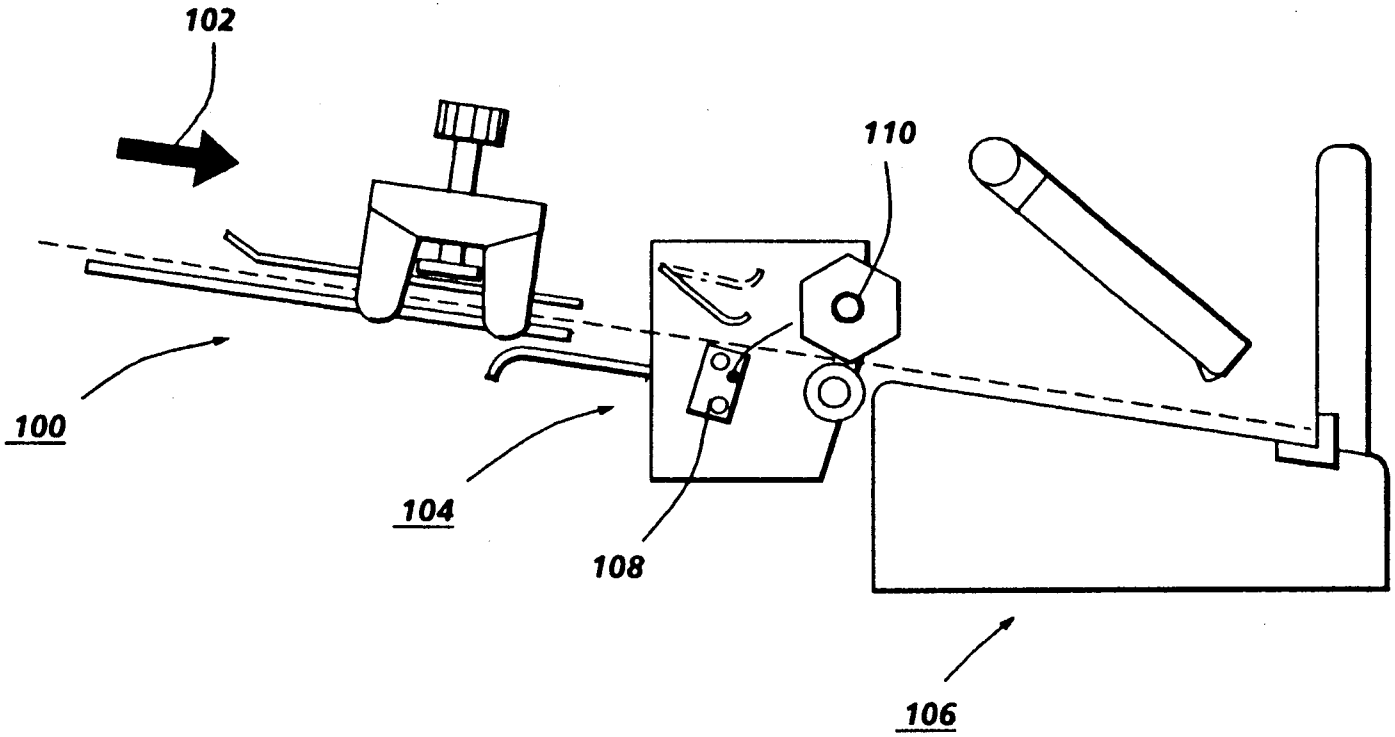
FIG. 2 is a schematic elevational view showing the finishing station of the FIG. 1 printing machine.
Figure 3:
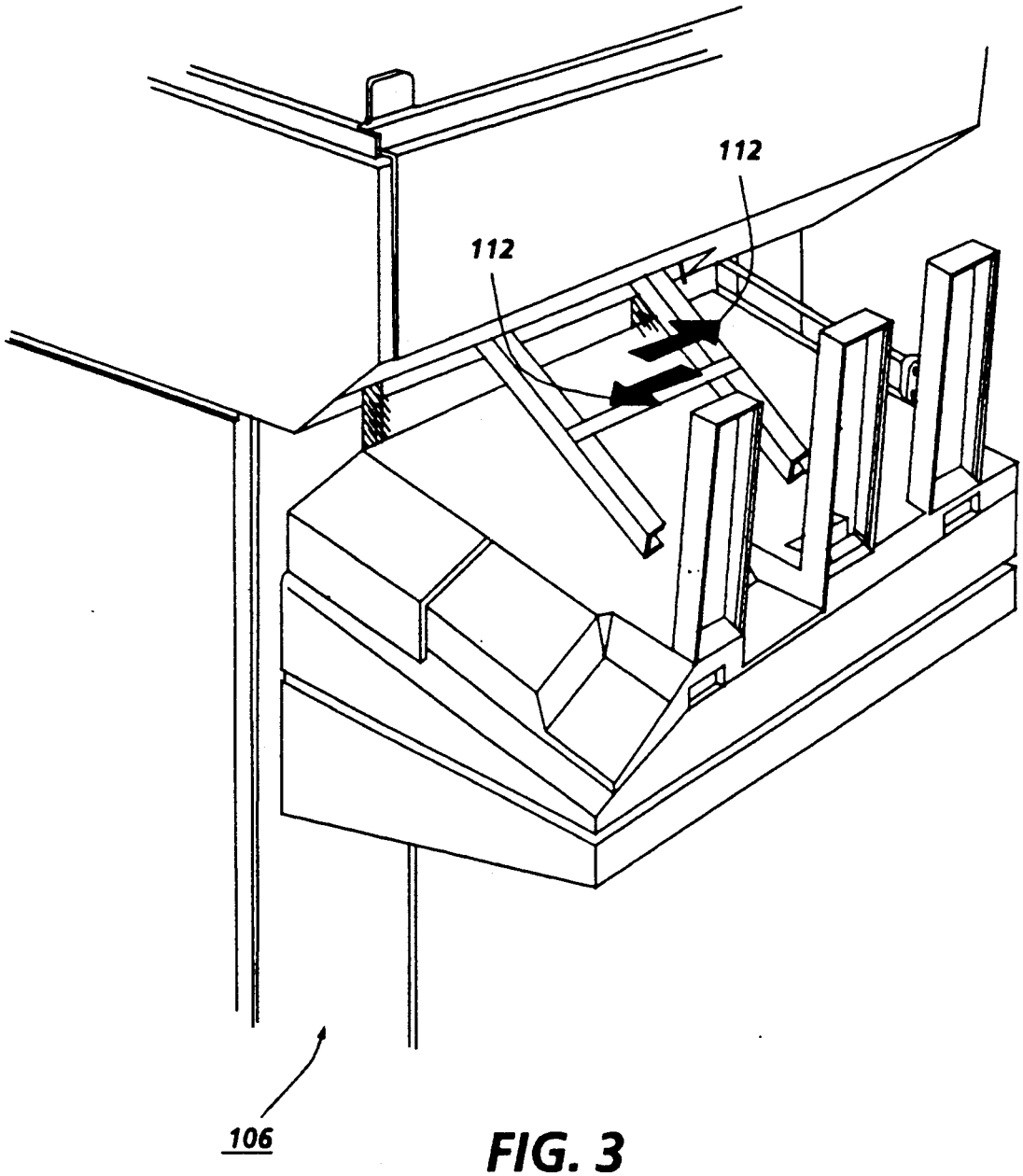
FIG. 3 is a perspective view illustrating the stacker of the FIG. 2 finishing station.

Referring now to FIG. 2, the general operation of finishing station F will now be described. Finishing station F receives fused copies from rolls 98(FIG. 1) and advances them in the direction of arrow 102 to the compiler tray, indicated generally by the reference numeral 100. Compiler tray 100 has two positions, an upper position and a lower position. When the staple option is selected, the compiler tray moves to the upper position in order to compile and be in position to staple the stacks of collated or uncollated copies. Once the stacks of copy sheets are stapled, the compiler tray moves to the lower position. The stapled stack of copy sheets is then ejected and the compiler tray raises to the upper position ready to compile the next stack of copy sheets for stapling. The lower position is used to compile stacks of collated or uncollated copy sheets that are not being stapled. After the completed stack of copy sheets is ejected from the tray, the compiler tray is ready to compile the next stack of copy sheets. When the control logic senses that a stack of collated or uncollated copy sheets is complete, the stack of copy sheets is ready to leave compiler tray 100. The stack of copy sheets is ejected into the output transport assembly, indicated generally by the reference numeral 104, which drives the stack of copy sheets out of compiler tray 100 into a stacker, indicated generally by the reference numeral 106. Output switch 108 senses each stack of copy sheets as it leaves compiler tray 100. Output switch 108 informs the controller if a jam occurs. If a jam does occur, the controller then declares a fault code. Stacks of copy sheets can range in thickness from about two sheets to one hundred sheets. Because of the wide range of sheet sizes and the varying thicknesses of the stacks of copy sheets, hexagonal shaped foam rolls 110 are used to provide a uniform nip force to drive the stacks of copy sheets to stacker 106. FIG. 3 shows the stacker in greater detail.

Turning now to FIG. 3, stacker 106 receives the stacks of copy sheets from compiler tray 100. Stacker 106 adjusts to the size and quantity of the selected job by moving in the vertical direction and the widthwise direction. Stacker width movement occurs at the start of any job that has the finisher selected. The controller senses the size of the copy sheet that is in the selected copy sheet tray of the printing machine. A motor moves the stacker tray to the appropriate width. Vertical movement of the stacker ensures that each stack of copy sheets being delivered to the stacker does so at the same angle. A motor will continue to lower the stacker tray so that the top of the stack stays a specific distance from the stack exit point. The controller senses when the stacks of copy sheets have been removed and will raise the stacker tray to the highest position. Thus, a plurality of stacks of collated or uncollated copy sheets may be stacked on the tray of stacker 106. When more than one stack of copy sheets is being made, the stacker may offset adjacent stacks of copy sheets from one another by moving in the direction of arrows 112 between successive stacks of copy sheets. A trained operator, such as a customer service representative or a dedicated operator, may select whether or not adjacent stacks of copy sheets are to be offset from one another. Generally, the selection of offset control is made in the diagnostics access mode of the printing machine. In this way, successive stacks of uncollated copy sheets may be offset from one another while successive stacks of collated copy sheets are inhibited from being offset from one another. Further details of offsetting stacks of copy sheets from one another is discussed with reference to FIG. 4.

FIG. 4 shows the apparatus for controlling offsetting stacks of collated and uncollated copy sheets from one another. Stacker 106 includes a tray 114. Tray 114 is moved to its two offset positions by an AC motor 116 coupled to a surface cam 118. Cam 118 has a groove that a pin attached to the lower portion of tray 114 follows when motor 116 rotates cam 118. This groove translates the motor rotational movement into forward or reverse movement depending upon the direction that motor 116 is commanded to rotate. Guide pins in slots on the lower portion of tray 114 allow forward or reverse movement of the tray while maintaining the height and width of the tray. Switches 120 and 122, when actuated, signal to controller 96 that the tray is in the forward or reverse position. The controller, in turn, signals to stop forward or reverse movement. In this way, while stacks of copy sheets are being loaded onto the tray, the tray alternately offsets adjacent stacks of copy sheets about 35 millimeters.

The number of copy sheets in each stack is controlled by controller 96 of the printing machine. Depending upon the operator selection, successive stacks of copy sheets may or may not be offset from one another. A display, indicated generally by the reference numeral 124, has a plurality of operator actuatable regions 126 and 128. Display 124 may be a keyboard having keys 126 and 128 thereon. Alternatively, display 124 may be a touch screen wherein discrete regions thereon display keys 126 and 128 which are operator actuatable by the operator touching the screen in the region thereof. Depending upon the key that is selected, display 124 transmits a signal to controller 96. In response thereto, controller 96 may actuate or inhibit motor 116 from rotating cam 118 so as to move tray 114 after the number of copy sheets corresponding to the selected stack size have been stacked thereon. Switches 120 and 122 transmit a signal to controller 96 indicating that the tray 114 has moved as required so as to offset successive stacks of copy sheets from one another at the correct interval. The operator may also determine the number of copy sheets in each stack of copy sheets that is offset from one another. Controller 96 includes a non-volatile memory which controls motor 116. Actuation of key 128 sets the bit position in the non-volatile memory to True for stacks of uncollated copy sheets. The operator may also select the number of sheets to be included in the stack by setting the number of copy sheets to be in each stack by actuating the appropriate keys on the number pad on the console of the printing machine until the desired number of copy sheets is displayed on the printing machine display. The operator may select one or a plurality of copy sheets for each stack. Each copy sheet of each stack may be a copy of the same original document. In this mode, successive stacks of uncollated copy sheets are offset from one another. The stacks of copy sheets may be stapled or unstapled. After this information is transmitted to controller 96, controller 96 energizes motor 116 at successive intervals after successive stacks having the selected number of copy sheets therein have been stacked on tray 114. Once again, switches 120 and 122 transmit a signal to controller 96 verifying that tray 114 has offset the stacks of uncollated copy sheets at the selected interval.

When key 126 is actuated, the bit position for offset inhibit in the non-volatile memory of controller 96 is set to True. This de-energizes motor 116 and the stacks of collated copy sheets stacked on tray 114 are aligned with one another. Thus, when key 126 is selected by the operator, there is no offset and the stacks of collated sheets on tray 114 are straight, i.e. in-line. In the default mode, i.e. when keys 126 and 128 are not actuated by the operator, the bit position for the non-volatile memory of controller 96 is Not True. Controller 96 de-energizes motor 116 when stacks of uncollated copy sheets are being advanced to tray 114. Thus, in the default condition, stacks of uncollated copy sheets are not offset from one another, but rather are aligned with one another. Furthermore, in the default mode, the bit position for inhibiting offsetting stacks of collated copy sheets is Not True. This causes controller 96 to energize motor 116 so that successive stacks of collated copy sheets are offset from one another. The number of copy sheets in each stack of collated copy sheets is equal to the number of sheets in the stack of original documents being reproduced.

In recapitulation, the apparatus of the present invention permits the operator to have the stacker of the printing machine offset stacks of uncollated copy sheet while stacks of collated copy sheets are not offset from one another. The number of copy sheets in the stack of uncollated copy sheets may also be selected by the operator. In the default mode, each stack of collated copy sheets is offset from one another while each stack of uncollated copy sheets is not offset, i.e. the stacks of uncollated copy sheets are aligned with one another.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

What is claimed is:

1. An apparatus for regulating offsetting stacks of sheets reproduced from at least one original document, including:

means for controlling offsetting of adjacent stacks of sheets from one another so that in one mode successive stacks of sheets are offset from one another and in another mode offsetting of the stacks of copy sheets from one another is inhibited, said controlling means includes means for selecting the number of sheets of each stack to be offset from one another;

means for receiving and supporting the sheets; and means, responsive to said controlling means, for moving said receiving and supporting means at selected intervals to offset each stack from one another, said moving means being de-energized in response to said controlling means inhibiting offsetting of the stacks of copy sheets from one another, wherein the sheets of each stack are uncollated and said controlling means energizes said moving means to offset successive stacks of uncollated sheets.

2. An apparatus according to claim 1, wherein each stack includes a plurality of sheets reproduced from one original document.

3. An apparatus according to claim 1, wherein said controlling means includes a non-volatile memory.

4. An apparatus according to claim 3, wherein said non-volatile memory includes a bit position for uncollated sheets which is true when each stack of sheets is offset from one another.

5. An apparatus according to claim 4, wherein said non-volatile memory includes a bit position for offset inhibit which is true when each stack of collated sheets is aligned with one another.

6. An apparatus according to claim 1, wherein said receiving and supporting means includes a tray.

7. An apparatus according to claim 6, wherein said moving means includes a motor coupled to said tray and regulated by said controlling means.

8. An electrophotographic printing machine of the type in which copy sheets reproduced from at least one original document are advanced to a finishing station for finishing and delivery of stacks of copy sheets to the printing machine operator, wherein the improvement includes:

means for controlling offsetting of adjacent stacks of copy sheets from one another with successive stacks of copy sheets being offset from one another in one mode and offsetting of the stacks of copy sheets from one another being inhibited in another mode, said controlling means includes means for selecting the number of copy sheets of each stack to be offset from one another;

means for receiving and supporting the sheets; and means, responsive to said controlling means for moving said receiving and supporting means at selected intervals to offset each stack from one another, said moving means being de-energized in response to said controlling means inhibiting offsetting of the stacks of copy sheets from one another, wherein the copy sheets of each stack are uncollated and said controlling means energizes said moving means to offset successive stacks of uncollated copy sheets.

9. A printing machine according to claim 8, wherein each stack includes a plurality of copy sheets reproduced from one original document.

10. A printing machine according to claim 8, wherein said controlling means includes a non-volatile memory.

11. A printing machine according to claim 10, wherein said non-volatile memory includes a bit position for uncollated copy sheets which is true when each stack of copy sheets is offset from one another.

12. A printing machine according to claim 11, wherein said non-volatile memory includes a bit position for offset inhibit which is true when each stack of copy sheets is aligned with one another.

13. A printing machine according to claim 8, wherein said receiving and supporting means includes a tray.

14. A printing machine according to claim 13, wherein said moving means includes a motor coupled to said tray and regulated by said controller to move at the selected intervals to offset successive stacks of copy sheets from one another.

15. A printing machine according to claim 9, further including means, located in the finishing station, for attaching at least each copy sheet of each stack to one another forming a pad of copy sheets.

16. A printing machine according to claim 15, wherein said attaching means includes means for stapling each stack so as to secure at least each copy sheet of each stack to one another forming the pad of copy sheets.

* * * * *